US006917019B2

(12) United States Patent
Richter

(10) Patent No.: US 6,917,019 B2
(45) Date of Patent: Jul. 12, 2005

(54) HEATING AND METHOD FOR CONTROLLING HEATING OF A FUNCTIONAL UNIT ON A MOTOR VEHICLE

(75) Inventor: Stefan Richter, Michelau (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 0 days.

(21) Appl. No.: 10/473,660

(22) PCT Filed: Apr. 16, 2002

(86) PCT No.: PCT/DE02/01463

§ 371 (c)(1),
(2), (4) Date: Sep. 30, 2003

(87) PCT Pub. No.: WO02/089526

PCT Pub. Date: Nov. 7, 2002

(65) Prior Publication Data

US 2004/0094529 A1 May 20, 2004

(30) Foreign Application Priority Data

Apr. 25, 2001 (DE) ..... 101 20 098

(51) Int. Cl.[7] ..... H05B 1/02

(52) U.S. Cl. ..... 219/505; 219/203; 219/202; 219/504; 219/497

(58) Field of Search ..... 219/505, 504, 219/494, 497, 202–206, 490, 491

(56) References Cited

U.S. PATENT DOCUMENTS

| | | | | |
|---|---|---|---|---|
| 4,984,736 A | | 1/1991 | Reiser et al. | |
| 5,280,158 A | * | 1/1994 | Matava et al. | 219/492 |
| 5,672,976 A | | 9/1997 | Egger et al. | |
| 6,508,408 B2 | * | 1/2003 | Kelly et al. | 236/91 C |
| 6,796,665 B1 | * | 9/2004 | Pillinger | 359/512 |

FOREIGN PATENT DOCUMENTS

| | | |
|---|---|---|
| DE | 38 20 442 C2 | 12/1989 |
| DE | 91 08 801.1 | 1/1992 |
| DE | 197 05 416 C1 | 3/1998 |
| DE | 197 40 169 A1 | 4/1999 |
| DE | 197 40 169 C2 | 4/1999 |
| DE | 299 23 543 U1 | 3/2001 |
| EP | 0 408 853 A2 | 1/1991 |
| EP | 1 091 621 A1 | 4/2001 |
| FR | 1.008.813 | 5/1952 |

OTHER PUBLICATIONS

International Search Report of PCT/DE02/01463, dated Nov. 7, 2002.

International Preliminary Examination Report of PCT/DE02/01463, dated Feb. 21, 2003.

English Translation of International Preliminary Examination Report of PCT/DE02/01463, dated Feb. 21, 2003.

* cited by examiner

*Primary Examiner*—Mark Paschall
(74) *Attorney, Agent, or Firm*—Christie, Parker & Hale, LLP

(57) ABSTRACT

Heating of a functional unit is started by a control device. An actual temperature or a parameter dependent on the actual temperature is monitored during, and optionally before and after the actual heating of the functional unit. A characteristic feature of the time course of the actual temperature or of the parameters dependent on the heating temperature, which determines the phase transition of water, serves for the evaluation and control of the heating. Analysis of the characteristic features is used to control the heating power of the heating elements. Threshold values and further factors such as proportionality factors for the controller, for example, are determined depending upon significant characteristics. The threshold values and factors are also particularly used for a subsequent starting of the heating using the corresponding analysis and control.

21 Claims, 5 Drawing Sheets

HEATING AND METHOD FOR CONTROLLING HEATING OF A FUNCTIONAL UNIT ON A MOTOR VEHICLE

CROSS-REFERENCE TO RELATED APPLICATION(S)

This application is a National Phase Patent Application of International Application No. PCT/DE02/01463, filed on Apr. 16, 2002, which claims priority of German Patent Application No. 101 20 098.6, filed on Apr. 25, 2001.

FIELD

The invention relates to a heating system and method for controlling heating of a functional unit on a motor vehicle.

BACKGROUND

Heating of functional units (or as used sometimes herein "heatable components") on motor vehicles are electric where heating resistances are fed from the battery or generator (alternator) or are heated by the engine through the air. Heating a heatable component such as a side mirror, a lock or a windshield of a vehicle is usually undertaken by at least one electric heating element whose heating power can be controlled electrically by for example an operator switch.

EP 0 408 853 A2 teaches heating a vehicle side mirror where, for heating, the current flow through a heating conductor is controlled by a semi-conductor switch. The semi conductor switch is controlled through a temperature sensor and a two-stage amplifier circuit which behaves like a Schmitt trigger. The semi conductor switch thereby forms one of the two stages which are coupled together for the Schmitt Trigger behavior. The drawback with this solution is that when the temperature drops below 27° C. the heating current is switched on until a temperature of 30° C. is reached even if heating is not necessary for a clear view of the mirror surface. The amount of energy required for the heating device for the mirror glass is therefore increased unnecessarily.

DE 197 05 416 C1 teaches a method for controlling the heating of a rear windshield of a vehicle where the heating of the rear windshield is switched off at least after a certain switch-on time. The certain switch-on time of the rear windshield heater is extended as the drive speed of the vehicle increases. This extension of the switch on time can also lead to strain on the on-board power supply or vehicle battery without any benefits to the vehicle occupants.

In DE 91 08 801 U1, a voltage drop which is dependent on the temperature of the mirror glass is compared by a comparator with a reference value and a switch of the comparator is controlled based on the result of the comparison. The heating current for this purpose is compared with a reference value. A control device containing the comparator for heating the mirror glass on a vehicle side mirror is provided with a heating resistance which can be switched to a current source by means of a switch. The comparator detects the voltage drop at a resistance through which the heating current flows and compares it with a reference value. The switch of the comparator is controlled depending on the result of the comparison. The use of the temperature path of the specific resistance of the heating resistance is based on the fact that the temperature of the heating resistance, which rests with its full or partial surface on the mirror glass, corresponds roughly to a mean value of the temperatures of the different mirror glass regions, when the heating current is interrupted. A high set reference value or a large manufacturing tolerance of the heating resistance leads in turn to a poor energy utilization of the vehicle battery.

Therefore, a method or device for heating a functional unit on a motor vehicle which reduces the energy consumption required by the heating would be beneficial.

SUMMARY

The present invention is directed to a heating system and a method for controlling the heating for a functional unit ("heatable components") on a motor vehicle.

The heating of the functional unit is started automatically or manually by a control device. Starting can be triggered, for example, by operating a manual actuating device, remote control, button or switch when the vehicle detects that the heating of the functional unit is required for proper functioning of the unit. Alternatively, starting can be carried out automatically by the control device generally starting up the heating to ensure functional reliability or by the control device recognizing that inadequate functional reliability is probable. As an example, detecting that the door lock will not function properly due to icing up leads to an automatic starting of the heating and thus to thawing of the door lock.

An actual temperature, or a parameter dependent on the actual temperature, is determined. The actual temperature is dependent on the temperature of the element of the functional unit which is to be heated or on the temperature of the heating element of the heater. The actual temperature is a specific, preferably measured, input value of the thermal system comprising the heating and the functional unit which is to be heated. The actual temperature is correlated during the actual heating time period, thus the time of the supply of heating energy to the actual heating temperature. In addition, one or more ideal temperatures can be provided which as comparison value depict the desired temperature of the heated functional unit depending on the different operating modes of the heating. As parameter is used an electronically evaluated value, such as the power take-up, energy take-up or the power balance of the heating and in particular a measured value. The dynamics of the values, the time dependence of the parameters can vary depending on the surrounding conditions, such as the air temperature or the heat transfer resistance etc. For simplicity, the actual value is detected in binary steps, for example so that the range from −40° C. to +87° C. is divided into 128 binary steps.

Characteristic features of the time path (or as used sometimes herein "temporal course") of the actual temperature or of the parameter dependent on the actual temperature serve to evaluate and control the heating. In one embodiment, a characteristic feature is the speed of cooling of the functional unit during a heating pause. For example, if the cooling stagnates in the region of 0° C. heating temperature, while the air temperature is below 0° C., then the control device can detect any icing up of the functional unit and the heating power can be raised for the control.

The characteristic features of the time path which determine the phase transition of water are evaluated. The water causes functional breakdowns by icing, fogging up or misting up the functional units of the vehicle. The phase transitions of the water from the solid phase to the liquid phase or to the vapor phase, which might possibly take place during the heating or cooling phases, generate characteristic features of the time path of the actual temperature, which are evaluated for controlling the heating until the functional breakdown caused by the water has been cleared. The characteristic features of the time path of the actual temperature determining the phase transition of water can be determined, for example, by integration, simple or multiple derivation according to time, through transformation or convolution. Determining the actual temperature can take place quasi continuously. Alternatively, the actual temperature can be measured at certain time points, which adapt to the changing speed of the temperature and in addition whose number in the vicinity of the characteristics can be varied.

The evaluation of the characteristic features is used to control the heating power of the heating element. Several parameters can be evaluated at the same time. In one embodiment, for evaluating or analysis the characteristic features are used directly for control so that determined values are used identically. In another embodiment, images or transformations of the characteristic features are used for control. For example, a special characteristic feature is copied to the associated actual temperature, more particularly a phase transition is transformed to the temperature of the phase transition. This transformation can include the displacement of the phase transition depending on further parameters, such as, for example, the convection produced by the vehicle's speed or the air pressure. Threshold values and further factors such as proportionality factors are determined for the control based on the significant characteristics. More particularly, the threshold values and factors are also used for a later starting of the heating, for example after 24 hours, with the associated evaluation and control.

If the method or the control device is used for a vehicle side mirror or composite glass pane then the critical actual temperature which could lead to breakage of the functional unit is not reached in that the heating is controlled using characteristic features. The heating power is turned down before reaching the critical actual temperature or after phase transition has taken place or the heating is switched off completely.

In a further embodiment of the invention, the heating can change into a second mode. In this second mode, different types of operation are possible. In order to reduce the energy consumption of the heating, the heating is switched off, turned down, regulated to a constant temperature or temporarily switched on and off according to specific cycles. These types of operation can also be combined with the previously mentioned monitoring. The type of operation, or a combination of several modes of operation, depends on the functional unit and on external environmental factors, such as rain, snow etc.

In another embodiment of the invention, the actual temperature or the parameter dependent on the actual temperature is determined before and/or after a heating time period. Thus the actual temperature is monitored outside of the heating time periods, and preferably also during the same, which can advantageously be used to increase or reduce the heating poweror to switch the heating on and off. The heating can be automatically started or the heating power can be increased before the heating time period the phase transition of water is determined, and depending on the determined phase transition. This is particularly advantageous since during driving, rapid outside temperature changes, for example when driving up into mountains, can lead to icing up of a wet vehicle side mirror.

If the heating however is only supplied with current during an actual heating phase in order to minimize the current consumption during the non-active times, for example when the ignition is switched off, in a further alternative embodiment of the invention the actual temperature or the parameter dependent on the actual temperature is determined only during a heating time period.

In a preferred embodiment of the invention, the control device has a means for evaluating different actual temperature rising speeds as characteristic features. In the previously mentioned example of a compound glass pane which is "misting up" or "fogging up" on which small water droplets have settled, the heating is operated until an evaporation temperature, for example 50° C. is reached. After another raised actual temperature rising speed, the actual temperature is kept constant through a corresponding regulation since the drops have already evaporated from the surfaces of the window pane. The means used are preferably an analog or a digital computer mechanism, more particularly an arithmetic logic unit with additional subtraction and division multiplication functions and algorithms. The dynamics of the temperature rise during the heating phase, or of the temperature drop during the heating pause or cooling phase, are thus specifically evaluated.

In a further embodiment of the invention, the heating element is a temperature-dependent heating resistance through which a heating current flows for heating. The temperature-dependent heating resistance, or a measured value dependent on the temperature-dependent heating resistance, is used as a parameter. In order to determine the heating resistance, a temporary wiring circuit can be used as a measuring bridge, a resonant circuit or the like. For this, the temperature-dependent heating resistance is connected to the control device. The heating power is controlled based on the measured value or the heating resistance which is connected to a control element of the control device. Usually, a heating resistance having a positive temperature coefficient is used. It is also possible to use a heating resistance of a semi conductor material with a corresponding negative temperature coefficient.

As a result of the large manufacturing tolerances of the heating resistance, as well as its aging effect and changes in the temperature coefficient of the heating resistance during manufacture and service life, a level of reliability in measuring the heating resistance itself as input measured value for heating control is possible. Only the inclusion of the underlying physical effect of the phase transition of water makes it possible, independently of the manufacturing and aging tolerances of this measuring-heating resistance, to reliably detect the actual thermal state of the functional unit. If a phase transition is detected, the measured values of the measuring-heating resistance for this phase transition are again set in proportion or the control takes place solely using the actual determination of a phase transition from the characteristics.

In a preferred embodiment of the invention, the time change of the heating resistance or the measure value dependent on the heating resistance is evaluated for controlling the heating. The control device has means, for example accumulator/memory and comparator, for evaluating the time change of the heating resistance or the measured value which is dependent on the heating resistance. If, for example, a micro computer unit is used for determining the time change then a clock, a timer or an impulse generator is connected to the micro computer unit.

In a further embodiment of the invention, a value of the heating resistance or of the measured value dependent on the heating resistance is determined for a minimum of the time change ($dR_H/dt$). This determined value serves as a comparison value for further evaluation, as well as for subsequent evaluations. At least one threshold value for control is determined from this value. If the value is obtained through several time-staggered determinations, several of these values are progressively averaged out in order to be able to evaluate long-term effects. Advantageously the value is stored for a melting temperature (0° C.). Thus, icing up of the functional unit can be easily determined by the control device.

Furthermore, a comparator compares the threshold values or the value in the further development with the heating resistance or the measured value. The output value, for example, is a binary signal from which the heating is controlled. The output value can also be a part of an algorithm with which the heating is controlled up or down. For a particularly simple evaluation, the heating resistance or the measured value is compared by a window comparator as comparator with an upper threshold value and a lower threshold value. Accordingly, the heating is switched off on exceeding the upper threshold value and is switched on again when falling below the lower threshold value. The threshold values can be determined analogous with the evaluation of the changing speed.

In a further embodiment of the invention, the temperature coefficient of the heating resistance is included in the evaluation. The temperature coefficient is previously determined by measuring technology, for example in a heat chamber, for a resistance material of one series. The heating is controlled depending on the value and temperature coefficient of the heating resistance. The actual temperature or a parameter dependent on the actual temperature is determined based on the value and the temperature coefficient from the heating resistance. The actual temperature can then be compared directly with the temperature of the atmospheric air, which is determined by a temperature sensor of the vehicle.

A number of methods are offered for controlling the heating. For a heating resistance, the heating voltage or the heating current can be varied, more particularly switched on or regulated as controllable values. In order to utilize the power of the control as efficiently as possible, the heating current is switched on in intervals to control the heating. The intervals are preferably variable in duration to regulate the temperature. If a faster regulation is required, particularly in the area of critical heating temperatures, then the heating current can be regulated by pulse width modulation for controlling the heating.

In order to prevent the functional unit from icing up the heating power is increased when the temperature of the functional unit drops to the region of about 0° C. The increase in the heating power is started based on detection of ice formation. Detection of the ice formation, thereby, takes place through significant characteristics of the time path of the heating temperature over the time.

In addition, the temperature sensor of the motor vehicle which measures air temperature and is independent of the heating is additionally evaluated for controlling the heating. If the windshield wipers are not activated for a long period of time, then the heating of the functional unit for air temperature above the region of around 0° C. is not switched on, since the control device expects neither rain nor ice which could impair the functional reliability. If the functional unit is nevertheless not capable of functioning because, for example, the vehicle's side mirror is covered with dew, then the vehicle occupant can manually start the heating.

BRIEF DESCRIPTION OF THE DRAWINGS

The invention will now be explained in further detail with reference to the embodiments illustrated in the drawings in which:

FIG. 4' shows the continuation of the flow chart of FIG. 4; and

DETAILED DESCRIPTION OF THE EMBODIMENTS

Figure 5:
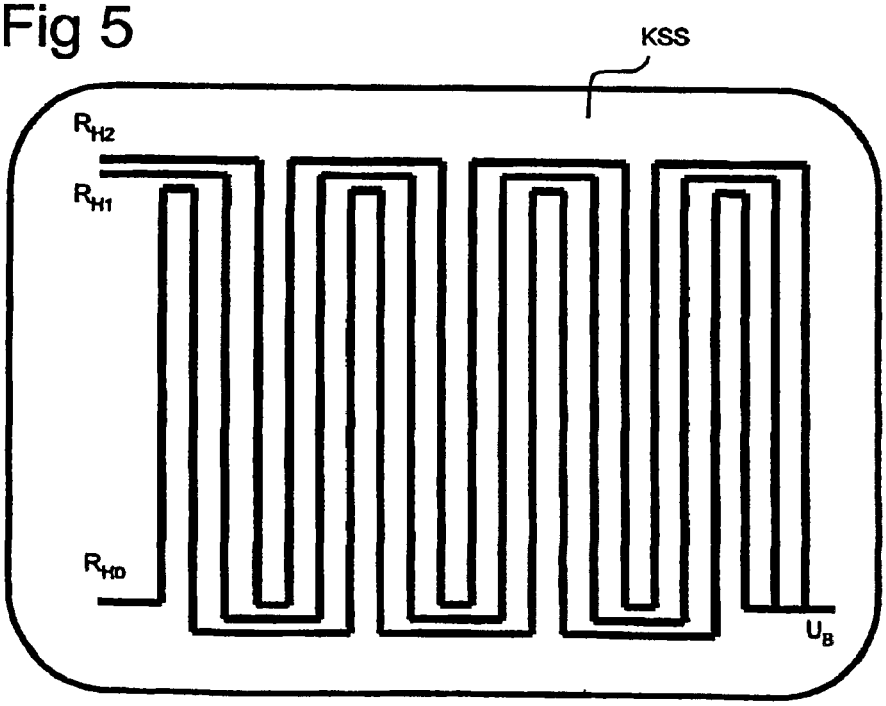
FIG. 5 shows a diagrammatic view of a vehicle mirror heating.

FIG. 5 shows a diagrammatic view of a vehicle side mirror KSS. On the back of the mirror layer there are several heating resistances $R_{H0}$, $R_{H1}$ and $R_{H2}$ arranged directly adjoining one another. The heating resistances $R_{H0}$, $R_{H1}$, and $R_{H2}$ take up the largest possible area of the effective mirror layer for the purpose of heating the same. For heating, the heating resistances $R_{H0}$, $R_{H1}$ and $R_{H2}$ are connected individually, in series or in parallel depending on the control. One of the heating resistances $R_{H0}$, $R_{H1}$ and $R_{H2}$ is temporarily switched in as a measuring resistance and its resistance value, which in the ideal case is dependent linearly on the actual temperature, is measured.

Figure 1A:
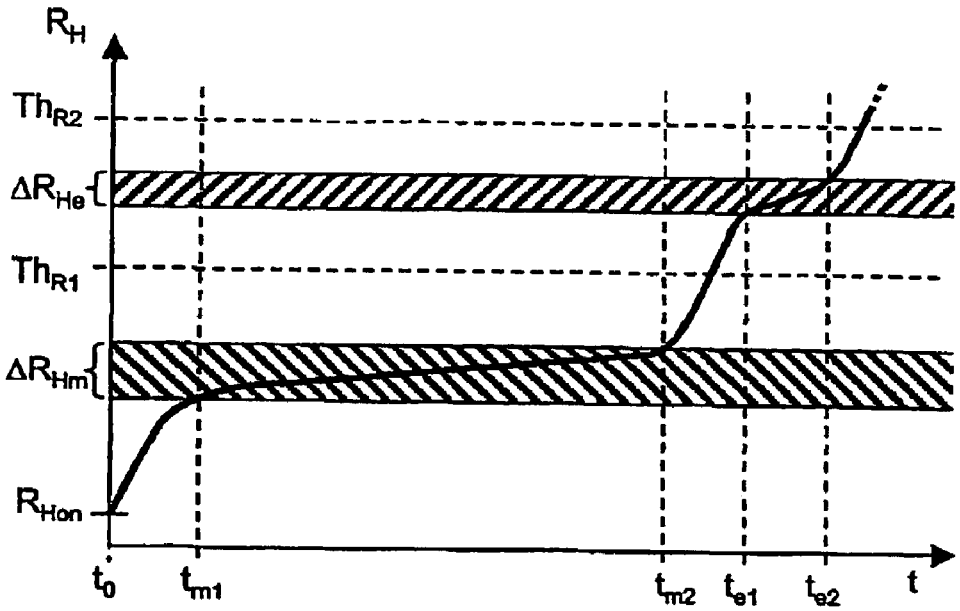
FIG. 1*a* shows a path of the heating resistance over time.

FIG. 1*a* shows a path (the thicker black line) of the heating resistance $R_H$ (on the z-axis) over the time t (on the x-axis) in the form of a chart. The path shown in FIG. 1*a* is purely an example. The path, or more particularly its resistance changes and the time length ratios, can vary based on the heat transfer resistances, heat capacities, air pressure, atmospheric temperatures and further factors. It is nevertheless first assumed that the resistance change of the measured heating resistance $R_H$ is proportional to the change of the heating temperature, and thus the actual temperature during a heating phase.

At time point $t_0$ (start of heating) the heating of the vehicle mirror is switched on. The heating resistance $R_H$ at the switch-on time point $t_0$ is $R_{Hon}$ (heating resistance value at start of heating). It is assumed in this special instance that the temperature of the vehicle mirror at the switch-on time point $t_0$ is below 0° C. Furthermore it is assumed that the vehicle mirror is iced-up and the ice adhering to the mirror surface obstructs the view of the vehicle occupant. The switched-on heating leads to the mirror and ice warming up.

At time point $t_{m1}$ (time start of melting), the melting temperature of the ice is reached. Further heating for the time being leads only to a small rise in the temperature of the vehicle mirror. Most of the heating energy is used for the phase conversion (i.e., melting) of ice into water and thus to the defrosting of the vehicle mirror. At time point $t_{m2}$ (time end of melting), the ice has substantially cleared away. Between time points $t_{m1}$ and $t_{m2}$ the heating resistance $R_H$ only raised by the amount $\Delta R_{HM}$ (change in heating resistance during melting). The first intermediate phase between ice and melted water is shown shaded in FIG. 1*a*.

Since no phase conversion takes place at $tm_2$, subsequent energy supply leads to the vehicle mirror and the melted ice warming up. If a part of the ice and melted ice drip from the mirror, the rising speed of the heating temperature at the end of melting $t_{m2}$ can differ from the rising speed before melting starts $t_{m1}$.

The second intermediate phase is caused by the evaporation of the water which covers the mirror surface. In order to dry the mirror, a heating temperature below 100° C. is sufficient. Additional effects which may influence drying are for example the driving speed, the wind or the microscopic surface structure or surface energies of the mirror surface. The duration of the evaporation phase from the start $t_{e1}$ (time beginning of evaporation) to the end $t_{e2}$ (time end of evaporation) deviates in the normal case from the first intermediate phase (melting phase) as a result of the environmental conditions and can last longer or shorter than the melting phase. Likewise, the heating resistance change $\Delta R_{He}$ of the evaporation phase differs from the heating resistance change $\Delta R_{Hm}$ of the melting phase.

Subsequently, further energy supply leads to a further increase in the heating temperature as shown in shading in FIG. 1*a*. A further increase in the heating temperature is however often undesirable and in some cases has no further benefit to the vehicle occupant. In order to control the heating, threshold values $Th_{R1}$ and $Th_{R2}$ are fixed and compared with the actual heating resistance value $R_H$. Further threshold values are preferably determined from a value of the heating resistance $R_H$ in the regions of the intermediate phases $\Delta R_{HM}$, $\Delta R_{He}$.

Figure 1B:
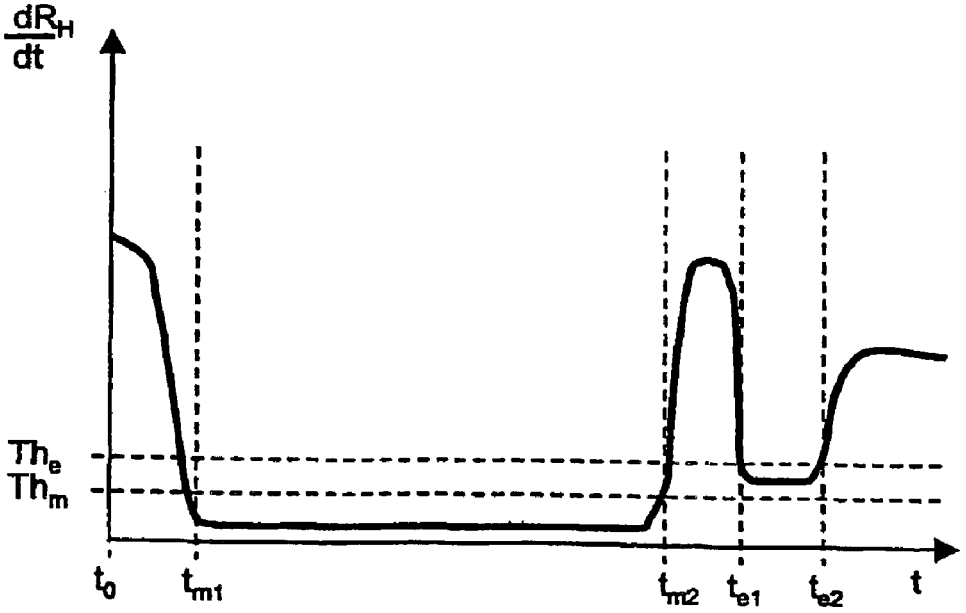
FIG. 1*b* shows a chart of the path of the time heating resistance change over time.

In order to determine these further threshold values the time change $dR_H/dt$ of the heating resistance $R_H$ is evaluated, as shown in FIG. 1*b*. FIG. 1*b* is a graph analogous to FIG. 1*a* and accordingly is subject to sharp fluctuations under real conditions as a result of changing atmospheric influences. The flank changes of the time change $dR_H/dt$ are used to trigger an evaluation so that the heating resistance $R_H$ is determined for the flank changes and its value is stored for a simultaneous or subsequent control of the heating. In addition the time values $t_{m1}$, $t_{m2}$, $t_{e1}$, $t_{e2}$ as well as the time differences ($t_{m2}-t_{m1}$, $t_{e2}-t_{e2}$) are advantageously stored and evaluated in connection with the threshold values $Th_{R1}$, $Th_{R2}$ etc for control. For example, if there is only a slight time difference between $t_{e2}-t_{e1}$ and the threshold values $Th_{R1}$ and $Th_{R2}$ the interpretation is that no moisture is present on the mirror surface and the heating is to be switched off for a longer time period.

FIG. 1*b* shows graphically that the rising speeds $dR_H/dt$ of the two intermediate phases, the melting phase and the evaporation phase, can be different. Also, the rising speed $dR_H/dt$ of the heating phases before or after the intermediate phase can be different. For control, further threshold values $Th_m$ and $Th_e$ are provided or determined which are compared for evaluation with the rising speeds $dR_H/dt$. The heating can be controlled additionally or alternatively in dependence on the rising speed $dR_H/dt$ (the derivation of heating resistance over time) and the threshold values $Th_m$ and $Th_e$.

Figure 2:
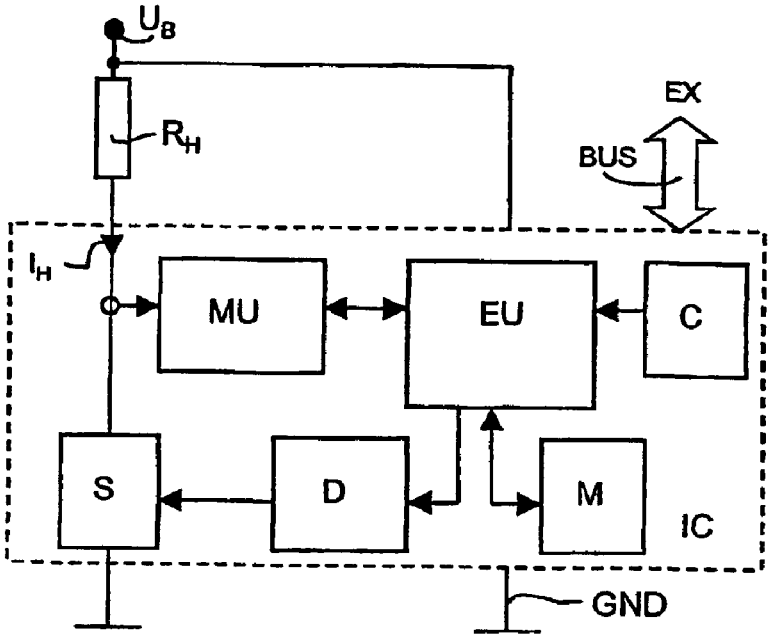
FIG. 2 shows a circuit diagram for a control device according to an embodiment of the present invention.

FIG. 2 shows a circuit diagram of a control device IC for controlling the heating of a functional device, such as the vehicle side mirror KSS. The control device IC is connected through a CAN BUS (or a BUS or a CAN), or another bus, such as VAN, a Token Ring or the like, to further external units EX of the vehicle. Further data such as, for example, on the operation of a windshield wiper is supplied to the control device IC through the BUS (a serial or parallel data bus). The operation of the windshield wiper is included by the control device IC into the evaluation so that, for example, if the windshield wiper is turned on, rain is concluded and the mirror is heated, at least temporarily, to evaporation temperature. Furthermore the control device IC can be connected to an input device for manually operating heating functions.

The control device IC is connected in series with the heating resistance $R_H$ through which the heating current $I_H$ flows. The control device IC is attached to the battery voltage $U_B$ (voltage of vehicle battery), for example to earth GND (ground). For control, the control device IC has a switch S with a connected dedicated driver D (also a driver). The driver D is connected to a computer unit EU of the control device IC. A measuring unit MU of the control device IC is connected to the heating resistance $R_H$. The measuring unit MU can determine or measure a voltage or current, for example. The measuring unit MU is further connected to the computer unit EU for evaluation of the measured values. In order to determine the temperature-dependent heating resistance $R_H$ or measured value, the heating resistance $R_h$ is switched, at least temporarily, as element of for example a measuring bridge which is a part of the measuring unit MU. In an alternative embodiment, the measuring unit MU can also be in active connection with a temperature sensor (not shown in FIG. 2) which is coupled thermally to the heating resistance $R_H$ or to the function unit ("heatable component") which is to be heated.

In another embodiment, in order to determine the temperature-dependent heating resistance $R_H$ or the measured value, the heating resistance $R_H$ is switched at least temporarily as element of a resonant circuit, which is a part of the measuring unit MU. The heating resistance $R_H$ is determined based on the frequency of the resonant circuit. Apart from these embodiments, other measuring methods and measuring units MU can also be used to determine the heating resistance $R_H$.

In the present embodiment of the invention, the evaluation and control can take place continuously in time. In a preferred embodiment, the control device also comprises a digital computer unit for evaluation and control. This enables the calculation of complex functions and inclusion of temperature-independent factors, such as including the activation of a windshield wiper into the evaluation. In this embodiment, the computer unit is connected to a memory M, more particularly a non-volatile memory (EEPROM) for storing, for example, the threshold values $Th_m$ and $Th_e$.

In addition, the digital control device IC has a clock, a timer or an impulse generator C (cycle transmitter or impulse transmitter) as a time basis. The time basis C enables keying the digital elements of the control device IC, and also determining or calculating the times $t_0$, $t_{m1}$, $t_{m2}$, $t_{e1}$ and $t_{e2}$. Determination of the measured values of the measuring unit Mu, thus, takes place based on time. By way of example, the time change $dR_H/dt$ of the heating resistance or the heating temperature is determined from the difference between two successive time-based measured values.

Figure 3A:
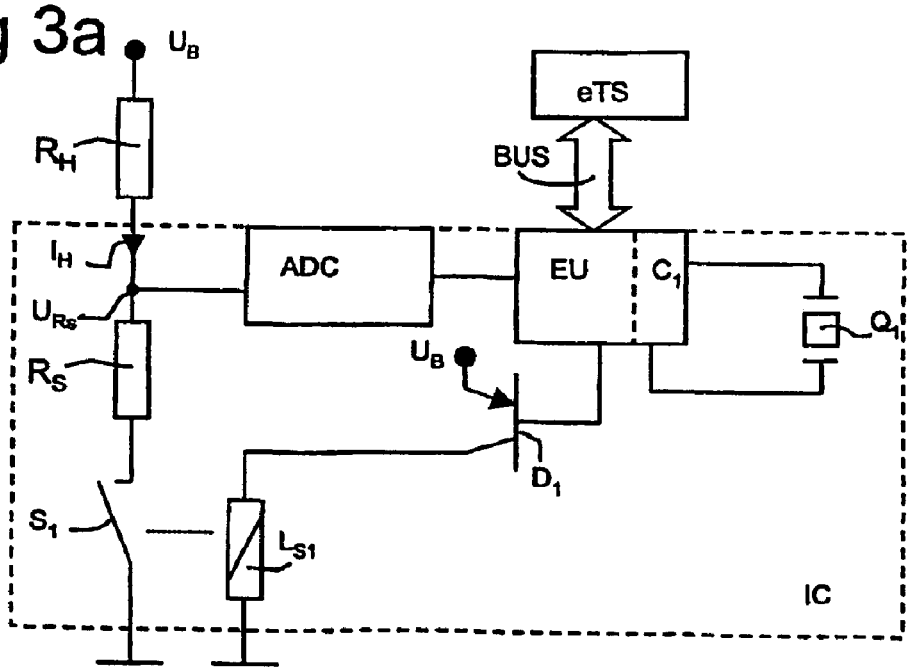
FIG. 3*a* shows a circuit diagram for a control device according to an embodiment of the present invention.
Figure 3B:
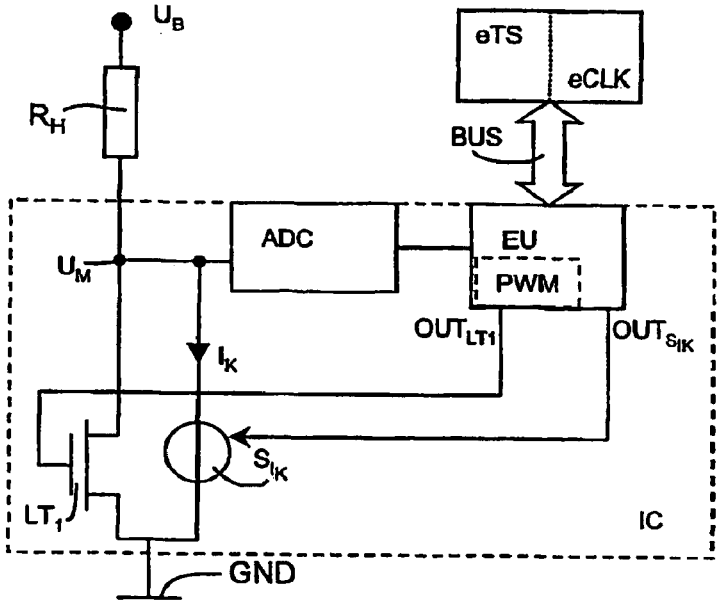
FIG. 3*b* shows a circuit diagram for a control device.

Detailed diagrams of embodiments a control device IC are shown in FIG. 3*a* and FIG. 3*b*. FIG. 3*a* shows an embodiment of the present invention which involves a conventional solution of individual structural elements. The heating resistance $R_H$ is connected in series with a shunt-resistance $R_S$ or a measuring resistance $R_S$. The shunt resistance $R_S$ is thermally uncoupled from the heating resistance $R_H$ and, in the ideal case, has none or very little temperature-dependence. The heating resistance $R_H$ is determined from the heating current $I_H$ and a heating voltage $U_B-U_{RS}$. The heating current $I_H$ is determined from $U_{RS}/R_S$. The voltage drop at the $R_S$ is converted by an analog-digital converter ADC into measured digital values and is then evaluated by the computer unit EU. The computer unit EU has a counter $C_1$ (or a counter unit) which is connected to a resonant quartz $Q_1$ to generate a time basis. In one embodiment, the computer unit EU with the counter $C_1$ is a microcomputer unit.

An output of the computer unit EU is connected to a PNP transistor $D_1$ (driver transistor) for driving a relay coil $L_{S1}$. A relay switch $S_1$ is mechanically coupled to the relay coil $L_{S1}$ and can be used to switch the heating current $I_H$ in controlled heating intervals. Furthermore, the computer unit EU is connected through a BUS to an external temperature sensor eTS which measures the air temperature. When the external temperature sensor eTS determines air temperature above freezing point (0° C.), the heating is not switched on, since no ice is expected to be present on the mirror at that temperature.

FIG. 3*b* shows an embodiment of the present invention which enables integration of the control device IC in a so-called smart power technology. The control device IC has an integrated switching circuit with a computer unit EU and a power semi conductor $LT_1$, controllable by the computer unit EU based on a smart-power technology. The control device IC is connected through a BUS to further functional units such as a clock eCLK (external clock, external cycle transmitter or impulse transmitter) and an air temperature sensor eTS of the vehicle. The computer unit EU is connected to an analog digital converter ADC for detecting measured values.

For control, the computer unit EU has means for a pulse-width modulation PWM (or a unit for pulse width modulation). An output $OUT_{LT1}$ of the computer unit EU with the pulse-width modulated control signals is connected to a gate of a power MOSFETs $LT_1$ for controlling the heating. In order to generate a measured signal, the control device IC has a substantially temperature-independent constant current source $S_{IK}$ which is connected, at least temporarily, to the heating resistance $R_H$. A constant current $I_K$ of the constant current source $S_{IK}$ (or a constant current drop) generates a heating temperature-dependent measured voltage UM or $U_m$ (measuring potential, measuring voltage against earth), which is measured by the analog digital converter ADC. The constant current source $S_{IK}$ is controllable through a control output $OUT_{SIK}$ (control output of the constant current source) of the computer unit EU, for example for the reduction of the closed-circuit current. In a preferred embodiment, the power transistor $LT_1$ and the constant current source $S_{IK}$ consist of a single MOSFET (power transistor) whose gate voltage is varied accordingly for a constant current $I_K$ or for the full heating current $I_H$. As an alternative to the illustrated Low-side driver 1 a high-side driver can be used so that the heating resistance $R_H$ is connected between the high-side driver and earth GND.

In a further embodiment, in order to control several heating units which can heat different functional units through the control device IC, the control device IC has a multiplexer (not shown in the drawings) which cyclically connects the measuring unit MU of the control device IC to the heating resistance $R_H$ which is to be measured. In addition, the control device IC has several power transistors $LT_1$ in order to control the individual heating currents $I_H$.

Figure 4:
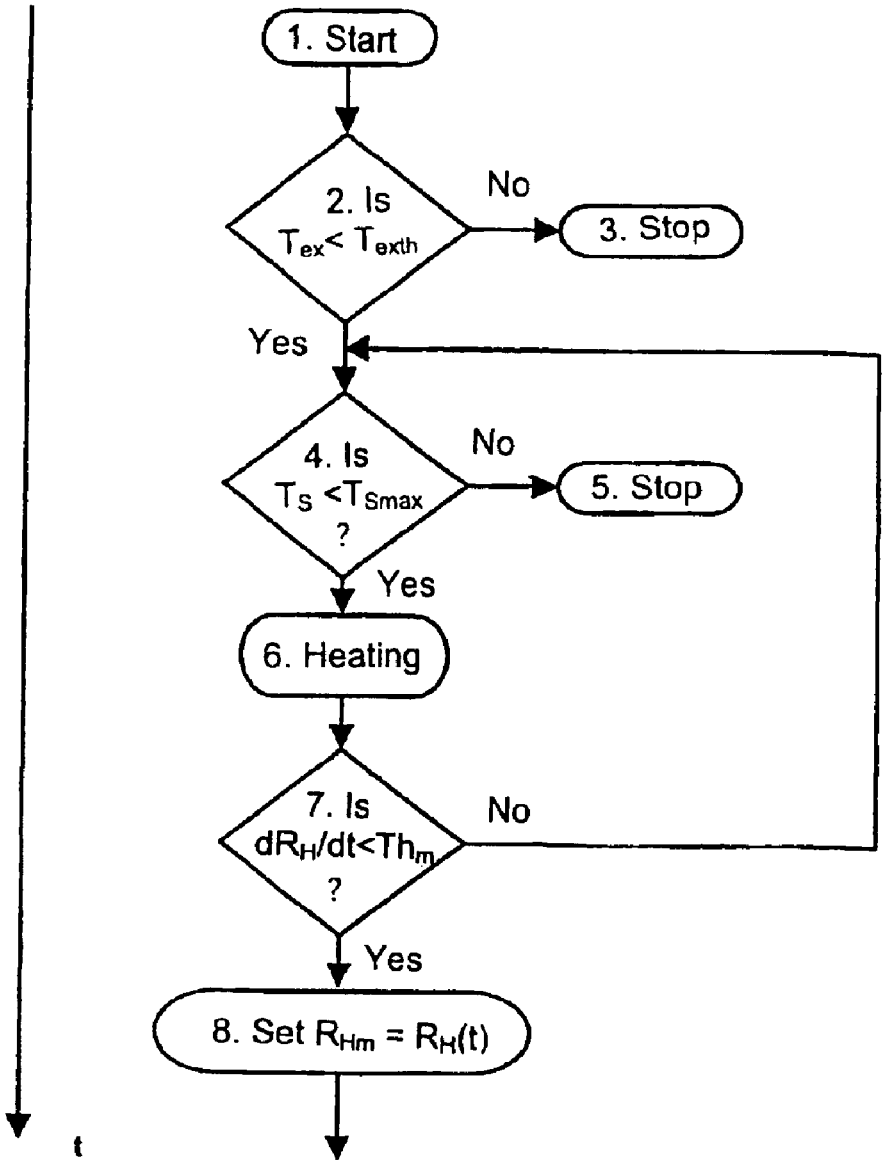
FIG. 4 shows a flow chart for the method of heating of a function unit according to an embodiment of the present invention.
Figure 4:
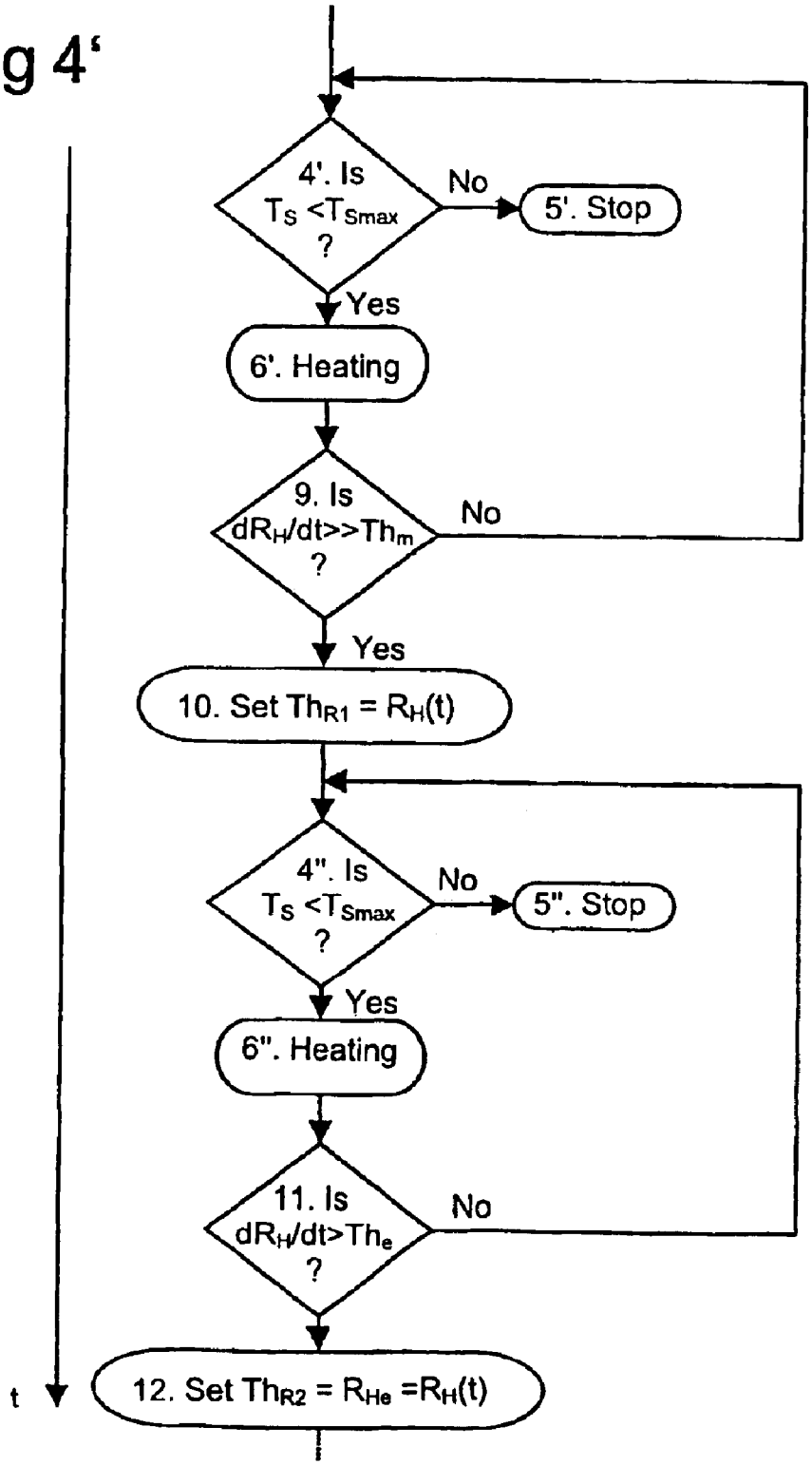

FIGS. 4 and 4' show a flow chart of a part of a program of the computer unit EU. FIG. 4' is a continuation of FIG. 4. In step 1 the heating is started up. The heating can be started, for example, by the vehicle occupant who would like to defrost the ice sticking to the vehicle's side mirror. Alternatively, the heating can also be started up automatically when, for example, the external temperature of the air is below 0° C. or the windshield wipers are switched on and signal rain.

Step 2 inquires as to whether an external parameter $T_{ex}$ is below a threshold value $T_{exth}$. By way of example, the external parameter $T_{ex}$ is outside temperature (surrounding air temperature) or information on whether the vehicle has been standing in a garage. In step 3, the heating is stopped accordingly. In step 4 a security question is asked. If the heating temperature $T_S$ (also a mirror temperature) is above a threshold value $T_{Smax}$ which represents the maximum permissible heating temperature (threshold value for maximum mirror temperature), then the heating is immediately stopped in step 5. Otherwise, if $T_S<T_{Smax}$, then the heating is controlled in step 6 and electric power is converted into heat.

After a certain heating duration in step 7, the time change $dR_H/dt$ of the heating resistance is evaluated and the time change $dR_H/dt$ is compared with a threshold value $Th_m$ for melting the ice. If the time change $dR_H/dt$ is greater than the threshold value $Th_m$, then steps 4, 5 and 6 respectively follow and in turn 7 again after a certain heating duration. If the time change $dR_H/dt$ is less than the threshold value $Th_m$, then the actual value of the heating resistance $R_H(t)$ is stored as the threshold value $R_{Hm}$ (heating resistance for melting phase). Steps 4', 5' and 6' respectively then follow similar to steps 4, 5 and 6.

In step 9, the time change $dR_H/dt$ of the heating resistance $R_H$ is again evaluated, and the time change $dR_H/dt$ is compared with the threshold value $Th_m$. If the time change $dR_H/dt$ of the heating resistance $R_H$ is substantially greater than the threshold value $Th_m$, then the actual value of the heating resistance $R_H(t)$ is stored as threshold value $Th_{R1}$. Steps 4", 5" and 6" apply analogous with steps 4, 5 and 6.

Step 12 is to be viewed analogous with step 10. In step 12, the time change $dR_H/dt$ is compared with a threshold value $Th_e$ for evaporating moisture adhering to the mirror. The actual value of the heating resistance $R_H$ (t) is stored as $Th_{R2}$ or as evaporation value $R_{He}$ (heating resistance for the evaporation phase).

In the following steps (not shown), the heating can be switched off for example. The stored threshold values $Th_m$, $Th_e$, $Th_{R2}$ and $Th_{R1}$ serve for evaluation and control of subsequent heating processes, by way of example after a new start-up of the vehicle.

If, for example, the vehicle is started up anew (the following method steps are not contained in the figures) the external temperature is detected as below 0° C. The heating resistance $R_H$ is supplied with current for heating. If on reaching the threshold value $R_{Hm}$ the time change $dR_H/dt$ of the heating resistance $R_H$ does not decrease, for example below the threshold value $Th_m$, then the heating is stopped. The mirror is apparently not iced up.

In an alternative embodiment, the heating temperature is determined by a heating temperature sensor thermally coupled to the function unit. The heating temperature sensor can be made independently of the manufacturing tolerances of the heating resistance and thus a particularly accurate determining of the actual temperature measured at the heating temperature sensor is possible. However this requires a very good thermal coupling between the heating resistance and the heating temperature sensor.

What is claimed is:

1. A method for controlling heating of a heatable component on a motor vehicle, the heatable component having at least one heating element whose heating power is electrically controlled, comprising:

starting heating of the function unit;

determining at least one of an actual temperature of the function unit and a parameter dependent on the actual temperature;

determining a temporal course of at least one of the actual temperature and the parameter dependent on the actual temperature;

evaluating at least one characteristic feature of the temporal course to determine a phase transition of water; and controlling the heating power of the at least one heating element based on the evaluation of the at least one characteristic feature.

2. The method of claim 1, wherein the step of determining the actual temperature or the parameter dependent on the actual temperature occurs before, after, or before and after a heating period.

3. The method of claim 1, further comprising the steps of determining the phase transition of water prior to a heating period; and at least one of automatically starting the heating and raising the heating power based on the determined phase transition.

4. The method of claim 1, wherein the step of determining the actual temperature or the parameter dependent on the actual temperature occurs only during a heating period.

5. The method of claim 1, wherein different falling and/or rising speeds of the actual temperature or of the parameter dependent on the actual temperature, caused by phase transition of water are evaluated as characteristic features.

6. The method of claim 1, wherein a minimum of the time change of the actual temperature or of the parameter dependent on the actual temperature, caused by a phase transition of water, is determined as a characteristic feature.

7. The method of claim 1, wherein the at least one heating element through which a heating current flows for heating is a temperature-dependent heating resistance, wherein as the parameter dependent on the actual temperature is determined the temperature-dependent heating resistance or a measured value dependent on the temperature-dependent heating resistance, and the heating power is controlled with reference to the determined temperature-dependent heating resistance or the measured value.

8. The method of claim 7, further comprising evaluating a time change of the heating resistance or the measured value dependent on the heating resistance in order to additionally control the heating; determining a value of the heating resistance or the measured value dependent on the heating resistance for a minimum of the time change; and comparing the heating resistance with the value or the measured value for subsequent evaluations.

9. A method of claim 1, further comprising storing the value of the actual temperature or the parameter dependent on the actual temperature.

10. The method of claim 8 or 9, wherein the heating is controlled based on the value and a temperature coefficient of the heating resistance by determining at least one threshold value based on at least one of the value of the heating resistance and the measured value dependent on the heating resistance;

comparing the heating resistance or the measured value by a comparator with the at least one threshold value; and controlling the heating based on comparison.

11. The method of claim 8, further comprising comparing, by a window comparator, the values of the heating resistance or the measured value dependent on the heating resistance with an upper threshold value and a lower threshold value;

switching off the heating if the value of the heating resistance or the measured value dependent on the heating resistance exceeds the upper threshold value; and switching on the heating if the value of the heating resistance or the measured value dependent on the heating resistance falls below the lower threshold value.

12. The method of claim 1, further comprising switching the heating current on in intervals; and regulating the heating current by means of a pulse width modulation.

13. The method of claim 7, further comprising determining the temperature-dependent heating resistance or the measured value based on at least one of the heating current and a heating voltage by means of at least one of flowing, at least temporarily, a constant current independent of the temperature through the heating resistance switching the heating resistance, at least temporarily, as an element of a measuring bridge, and determining the heating resistance by means of the measuring bridge, and switching the heating resistance, at least temporarily, as an element of a resonant circuit, and determining the heating resistance by means of the frequency of the resonant circuit.

14. A method of claim 1, further comprising using a temperature sensor of the vehicle to measure an air temperature independent of the heating; and controlling the heating based on the measured air temperature.

15. A heating system comprising a heatable component on a motor vehicle, with at least one heating element whose heating power is electrically controlled, and a control device configured to start heating of the function unit; determine at least one of an actual temperature of the function unit and a parameter dependent on the actual temperature; determine a temporal course of at least one the actual temperature and the parameter dependent on the actual temperature; evaluate the at least one characteristic feature of the temporal course to determine a phase transition of water; and control the heating power of the at least one heating element based on the evaluation of the at least one characteristic feature.

16. The heating system of claim 15, wherein the at least one heating element is a temperature-resistant heating resistance through which a heating current flows for heating and the control device further comprises a measuring unit and a control element, wherein the measuring unit is connected to the temperature-dependent heating resistance for measuring at least one of the temperature-dependent heating resistance and a value dependent on the temperature-dependent heating resistance, and the control element of the control device is connected to the heating resistance.

17. The heating system of claim 15 or 16, wherein, in order to determine a time change of resistance values of the heating resistance, the heating system further comprises:

at least one of a timer and an impulse transmitter connected to the control device, and an analog-digital converter of the measuring unit comprising an analog input connected to the heating resistance, wherein the at least one of a timer and impulse transmitter enables clocking of digital elements of the control device, and wherein the time change of at least one of the heating resistance and the heating temperature is determined from the differences between two successive time-based measured values.

18. The heating system of claim 15, wherein the control device further comprises at least one of a memory for storing a value of the actual temperature or a parameter for a characteristic of the time path of the actual temperature; and a constant voltage source, for determining the heating resistance, connected, at least temporarily, to the heating resistance and an integrated switch circuit with a computer and a power semi conductor controllable by the computer in smart-power technology.

19. The method of claim 1, wherein the function unit is at least one of a side mirror, a lock and a window pane.

20. The method of claim 9, wherein a value of the heating resistance or a measured value of a parameter dependent on the heating resistance for a specific phase transition of water is stored.

21. The heating system of claim 15, wherein the function unit is at least one of a side mirror, a lock and a window pane.

* * * * *